US008770342B2

(12) United States Patent
Wirth

(10) Patent No.: US 8,770,342 B2
(45) Date of Patent: Jul. 8, 2014

(54) MUFFLER

(75) Inventor: Georg Wirth, Kircheim/Teck (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 0 days.

(21) Appl. No.: 13/451,821

(22) Filed: Apr. 20, 2012

(65) Prior Publication Data

US 2012/0267189 A1 Oct. 25, 2012

(30) Foreign Application Priority Data

Apr. 21, 2011 (DE) ..... 10 2011 007 856

(51) Int. Cl.
*F01N 13/16* (2010.01)

(52) U.S. Cl.
USPC ..... 181/282; 181/268

(58) Field of Classification Search
USPC ..... 181/227, 228, 249, 251, 255, 257, 264, 181/268, 269, 272, 275, 282
See application file for complete search history.

(56) References Cited

U.S. PATENT DOCUMENTS

| | | | | |
|---|---|---|---|---|
| 2,071,351 | A * | 2/1937 | McNamara | 181/272 |
| 2,395,005 | A * | 2/1946 | Kuhn | 181/255 |
| 3,556,735 | A * | 1/1971 | Epelman | 422/171 |
| 5,670,756 | A | 9/1997 | Ohtaka et al. | |
| 6,179,086 | B1 | 1/2001 | Bansemir et al. | |
| 7,510,050 | B2 * | 3/2009 | Emler | 181/249 |
| 7,661,510 | B2 | 2/2010 | Muller | |
| 8,485,314 | B2 * | 7/2013 | Danner et al. | 181/282 |
| 2009/0078499 | A1 * | 3/2009 | Sikes et al. | 181/256 |
| 2010/0170744 | A1 * | 7/2010 | Kadandale | 181/282 |

FOREIGN PATENT DOCUMENTS

| | | | | |
|---|---|---|---|---|
| DE | 195 32 291 | A1 | 3/1996 | |
| DE | 198 04 718 | C2 | 9/2001 | |
| DE | 10 2005 027 314 | A1 | 12/2006 | |
| DE | 10 2007 017 661 | A1 | 10/2008 | |
| EP | 19 807 28 | B1 | 11/2009 | |
| JP | 61207813 | A * | 9/1986 | F01N 1/00 |

* cited by examiner

*Primary Examiner* — Jeremy Luks
(74) *Attorney, Agent, or Firm* — McGlew and Tuttle, P.C.

(57) ABSTRACT

A muffler (1) for an exhaust system of an internal combustion engine, especially of a motor vehicle, has a housing (2), which encloses a muffler volume (7) and has at least one flat wall area (6), with at least one inlet tube (3) and with at least one outlet tube (4) and with at least one bracket (5) for fastening the muffler (1) to a holding structure. A lightweight construction is simplified if at least one wall section (11) of such a flat wall area (6) is formed by a flat lightweight panel (12) with sandwich structure.

20 Claims, 4 Drawing Sheets

MUFFLER

CROSS REFERENCE TO RELATED APPLICATIONS

This application claims the benefit of priority under 35 U.S.C. §119 of German Patent Application DE 10 2011 007 856.8 filed Apr. 21, 2011, the entire contents of which are incorporated herein by reference.

FIELD OF THE INVENTION

The present invention pertains to a muffler for an exhaust system of an internal combustion engine, especially of a motor vehicle.

BACKGROUND OF THE INVENTION

A muffler usually comprises a housing, which encloses a muffler volume, as well as at least one inlet tube and at least one outlet tube. The muffler can be fluidically connected to the rest of the exhaust system via the inlet tube and the outlet tube. The muffler may have, in addition, at least one bracket, with which the muffler can be fastened to a holding structure, for example, of the internal combustion engine or preferably to the vehicle. The exhaust system is usually installed along an underbody of the vehicle in vehicle applications. The holding structure for fastening the housing is formed by an underbody area of the vehicle or of a vehicle construction. Since only a comparatively small space is available for installation in the underbody area, mufflers can be designed as comparatively flat, and their housing has at least one flat wall area, which faces, for example, the underbody of the vehicle or a road in the mounted state.

SUMMARY OF THE INVENTION

It is an object of the present invention to provide, for a muffler of the type mentioned in the introduction, an improved embodiment, which is especially suitable for embodying a lightweight construction.

According to the invention, a muffler is provided for an exhaust system of an internal combustion engine. The muffler comprises a housing, which encloses a muffler volume and comprises a flat wall area, an inlet tube connected to the housing and an outlet tube connected to the housing and a bracket connected to the housing for fastening the muffler to a holding structure. The flat wall area has a flat wall section formed by a flat lightweight panel having a sandwich structure.

The present invention is based on the general idea of embodying at least one wall section of such a flat wall area by means of a flat lightweight panel plate in a muffler, whose housing has at least one flat wall area. Such a lightweight panel has a hollow chamber structure or a sandwich structure and is characterized as a result by high flexural rigidity along with low weight. Such a flexurally rigid lightweight panel has a very low tendency towards vibration excitation, so that the risk of an undesired noise emission as well as the mechanical load of the muffler due to vibrations is reduced.

The sandwich structure of the lightweight panel may preferably have an inner shell, an outer shell and a support structure, which is arranged between the inner shell and outer shell and which supports or fastens to one another the inner shell and outer shell. The inner shell and outer shell extend essentially in parallel to one another within the flat lightweight panel. The support structure may have a plurality of individual cells, which are separated from one another via common walls, and these partitions extend at right angles to the inner shell and at right angles to the outer shell. Such a cell structure of the support structure may also be called a honeycomb structure. Such sandwich structures are characterized by extremely high stability along with low weight.

Corresponding to another embodiment, the corresponding lightweight panel may be inserted into an opening, which the flat wall area has and which is enclosed by an opening edge of the flat wall area. In other words, the flat wall area is provided with at least one opening to embody the housing in order to insert the separately manufactured lightweight panel therein. The corresponding lightweight panel closes the corresponding opening gas-tightly. To make it possible to connect the corresponding lightweight panel to the opening edge belonging to it firmly and gas-tightly, the sandwich structure of the lightweight panel may be compressed in an outer, circumferential edge area in order to form a flange, which can be connected to the circumferential opening edge in an especially simple manner, for example, by means of an adhesive bond, soldered connection or welded connection.

Corresponding to an advantageous embodiment, the corresponding bracket may be fastened to a flat wall area outside the corresponding lightweight panel. The lightweight panel thus assumes no supporting function, but is used only to limit the muffler volume in a gas-tight manner.

In addition or as an alternative, an inner bottom may be arranged in the housing, for example, in order to support at least one tube, for example, the inlet tube and/or outlet tube and/or another tube, on the housing. This inner bottom may also be fastened to the flat wall area outside the corresponding lightweight panel in order to relieve the lightweight panel of a holding function in this respect as well.

According to an especially advantageous embodiment, the corresponding flat wall area may be formed entirely by a lightweight panel. The corresponding flat wall area is formed in this case entirely by a flat lightweight panel, and provisions may advantageously be made in this case as well for the lightweight panel not to assume any support function but to be used only to limit the muffler volume in a gas-tight manner.

In another embodiment, the housing may have at least one non-flat wall area, which can also hereinafter be called a curved wall area. At least one wall section of such a non-flat wall area may be formed corresponding to an advantageous embodiment by a gas-tight film. Such a film is characterized, compared to a conventional wall, by a significantly reduced wall thickness. For example, such a film has a wall thickness of at most 0.5 mm, preferably at most 0.3 mm and especially at most 0.1 mm. Such a film cannot have any support function, but is used only for the gas-tight limitation of the muffler volume. The film may be designed as a single-layer film, as a result of which the corresponding wall section can be embodied at an especially low cost. It is also possible as an alternative to configure the corresponding film as a multilayer film in order to improve its stability, pressure load-bearing capacity and heat insulation.

The curved films are preferably curved such that they have sufficient dimensional stability to the inner pressure prevailing in the muffler volume. For example, the curved wall areas are arched for this outwardly, i.e., away from the muffler volume.

According to an alternative embodiment, at least one wall section of such a non-flat wall area may be formed by a spatially curved lightweight panel having a sandwich structure. Depending on the three-dimensional shape of the curved wall area, a correspondingly curved lightweight panel may thus be used as well. In particular, it is possible to manufacture larger sections of the housing, which comprise both a flat wall area and at least one non-flat wall area, from a one-part lightweight panel, which comprises at least one flat area and at least one non-flat area complementarily to the corresponding housing section.

Corresponding to another advantageous embodiment, a support structure may be provided, to which the inlet tube, outlet tube, bracket and lightweight panel are fastened. The support structure thus assumes all support functions within the muffler and thus make possible the desired relief of the corresponding lightweight panel.

An embodiment, in which the housing comprises exclusively flat and curved lightweight panels or flat lightweight panels and films, is possible as a result, in particular.

The support structure is preferably designed as a self-supporting structure, whereas the housing with its flat and non-flat wall areas is not designed as a self-supporting housing, but it ensures mainly the gas tightness of the muffler volume.

At least one tube, which is likewise fastened to the support structure, may be preferably arranged in the housing. At the same time, the tube may be used to stiffen the support structure by integrating the tube into the support structure.

Especially advantageous is an embodiment in which the support structure is designed as a framework structure. The support structure now has a plurality of nodes for fastening the inlet tube, outlet tube, bracket and lightweight panel. Furthermore, the support structure now has a plurality of carriers for connecting the nodes. Such a framework-like support structure can be configured in an especially stable form and at the same time especially easily.

Corresponding to a preferred embodiment, the housing may be a shell construction, so that the housing has at least two shell elements, wherein at least one of the shell elements has both at least one flat wall area and at least one non-flat wall area. It is, in particular, possible due to the shell structure of the housing to accommodate the support structure in the interior of the housing by closing the shells around the support structure.

The housing may also have angular edges and corners, which may be formed especially by suitable edge bodies or corner bodies in order to connect adjacent lightweight panels and/or films and/or conventional wall sections to one another.

It is apparent that the above-mentioned features, which will also be explained below, can be used not only in the particular combination indicated, but in other combinations or alone as well without going beyond the scope of the present invention.

Preferred embodiments of the present invention are shown in the drawings and will be explained in more detail in the following description, where identical or similar or functionally identical components are designated by the same reference numbers. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
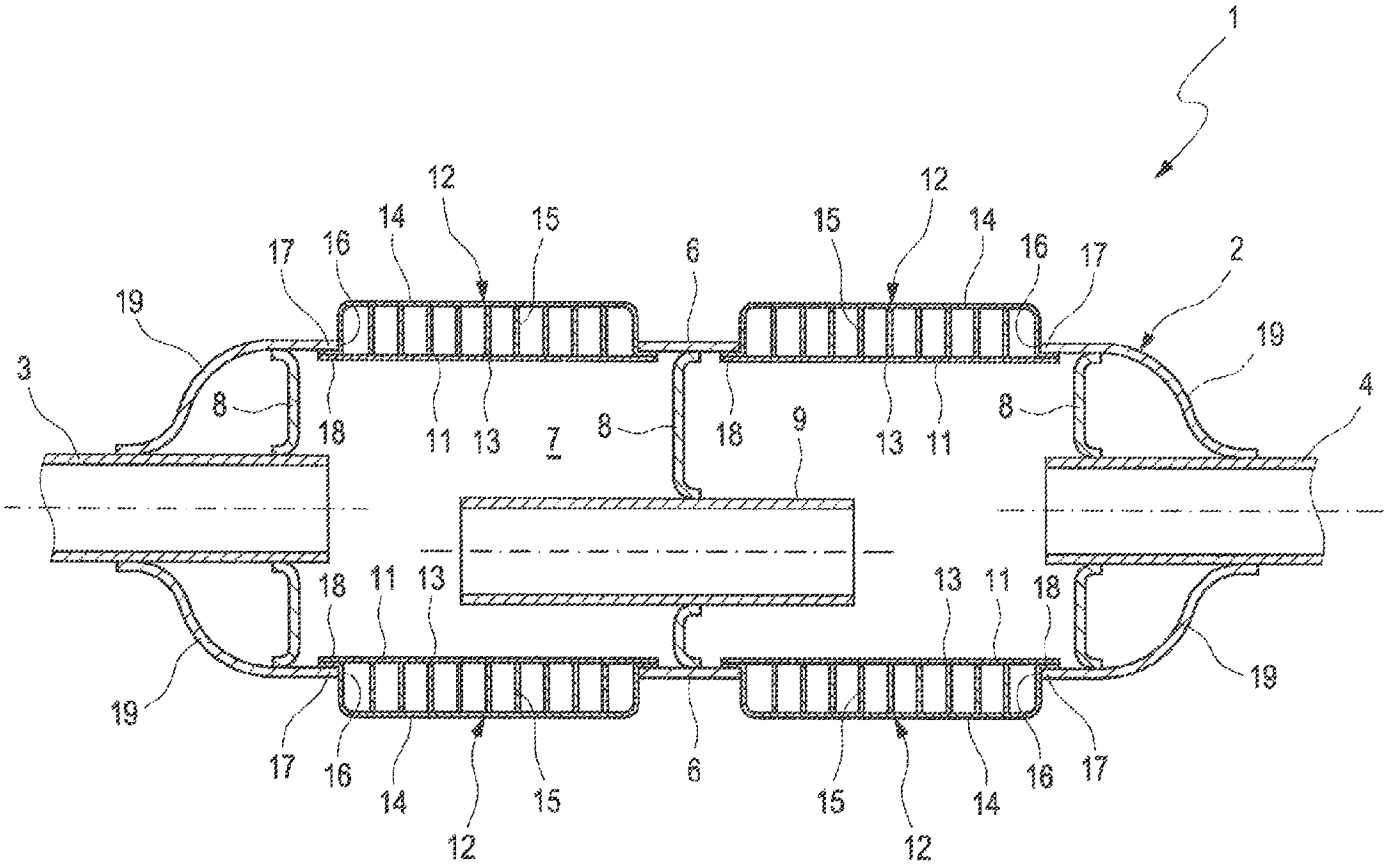
FIG. 1 is a highly simplified longitudinal sectional view through a muffler according to the invention.

Referring to the drawings in particular, corresponding to FIGS. 1 through 4, a muffler 1 comprises a housing 2, at least one inlet tube 3, at least one outlet tube 4 and at least one bracket 5. The muffler 1 is suitable for being mounted in an exhaust system of an internal combustion engine, preferably of a motor vehicle. The muffler 1 is especially suitable for being arranged in the area of an underbody of the vehicle. Housing 2 has for this at least one flat wall area 6, which may face in the installed state of the muffler 1, for example, the underbody of the vehicle or a road. Such a flat wall area 6 may also face a linearly extending tunnel wall, which is located in the underbody area of the vehicle for accommodating the exhaust system.

Housing 2 encloses a muffler volume 7, which is used, on the one hand, to form flow paths for the exhaust gas and, on the other hand, to provide a resonance volume and/or an absorption volume and/or a reflection volume and/or an expansion volume. At least one inner bottom (interior support/structural element) 8, by means of which at least one tube is supported at housing 2, may be arranged in housing 2. Three such inner bottoms 8 are provided in the examples according to FIGS. 1 through 4, with the inner bottom 8 arranged on the left supporting the inlet tube 3 at housing 2, while the inner bottom 8 shown on the right supports outlet tube 4 at housing 2. The middle inner bottom 8, which is located between the two outer inner bottoms 8, supports another tube 9 at housing 2. It is clear that the inner structure of muffler 1 should be understood here as an example only, so that other usual structures for ducting the exhaust gas and muffing the noise are conceivable as well.

Figure 2:
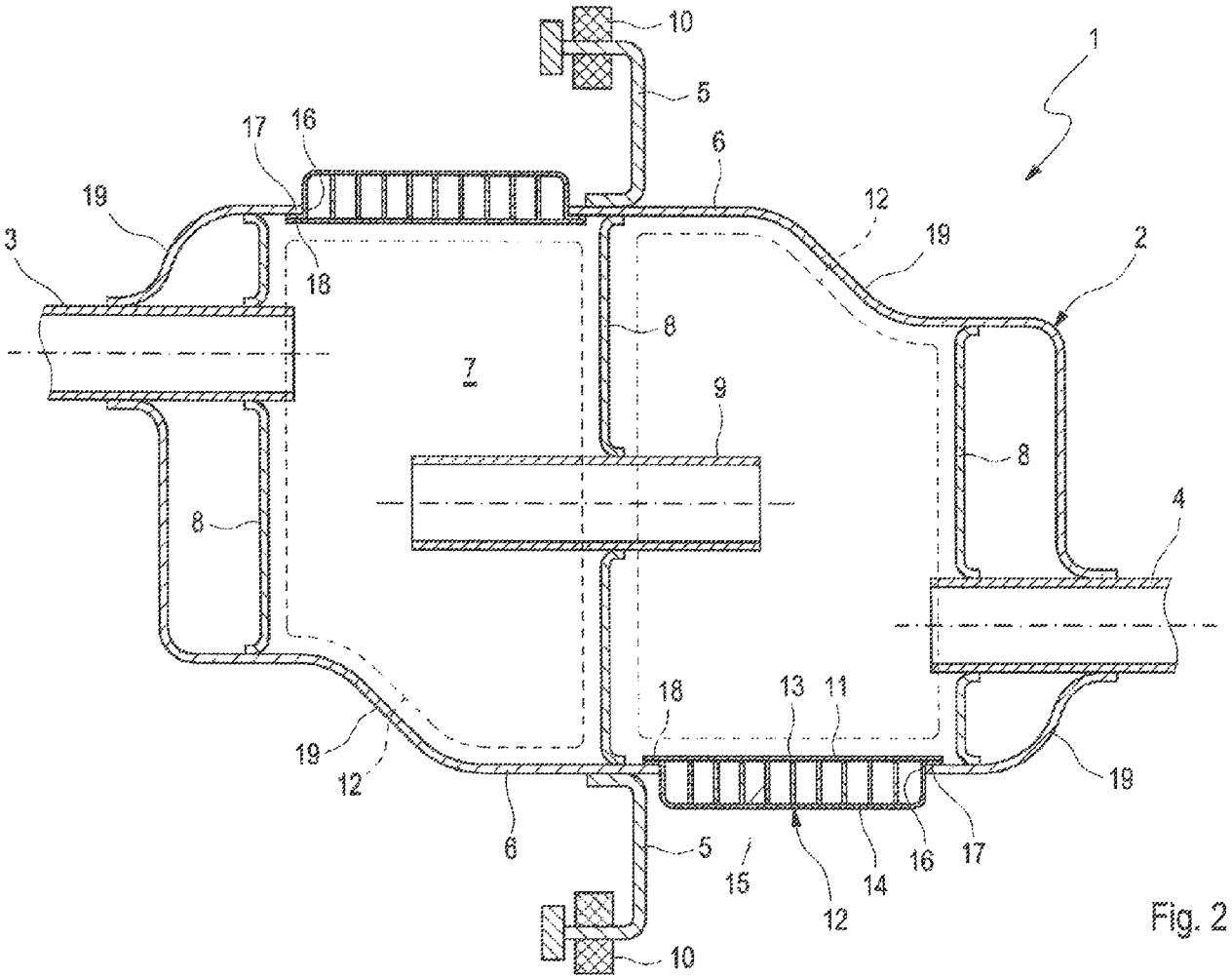
FIG. 2 is a longitudinal sectional view of the muffler from FIG. 1, rotated by 90°.
Figure 4:
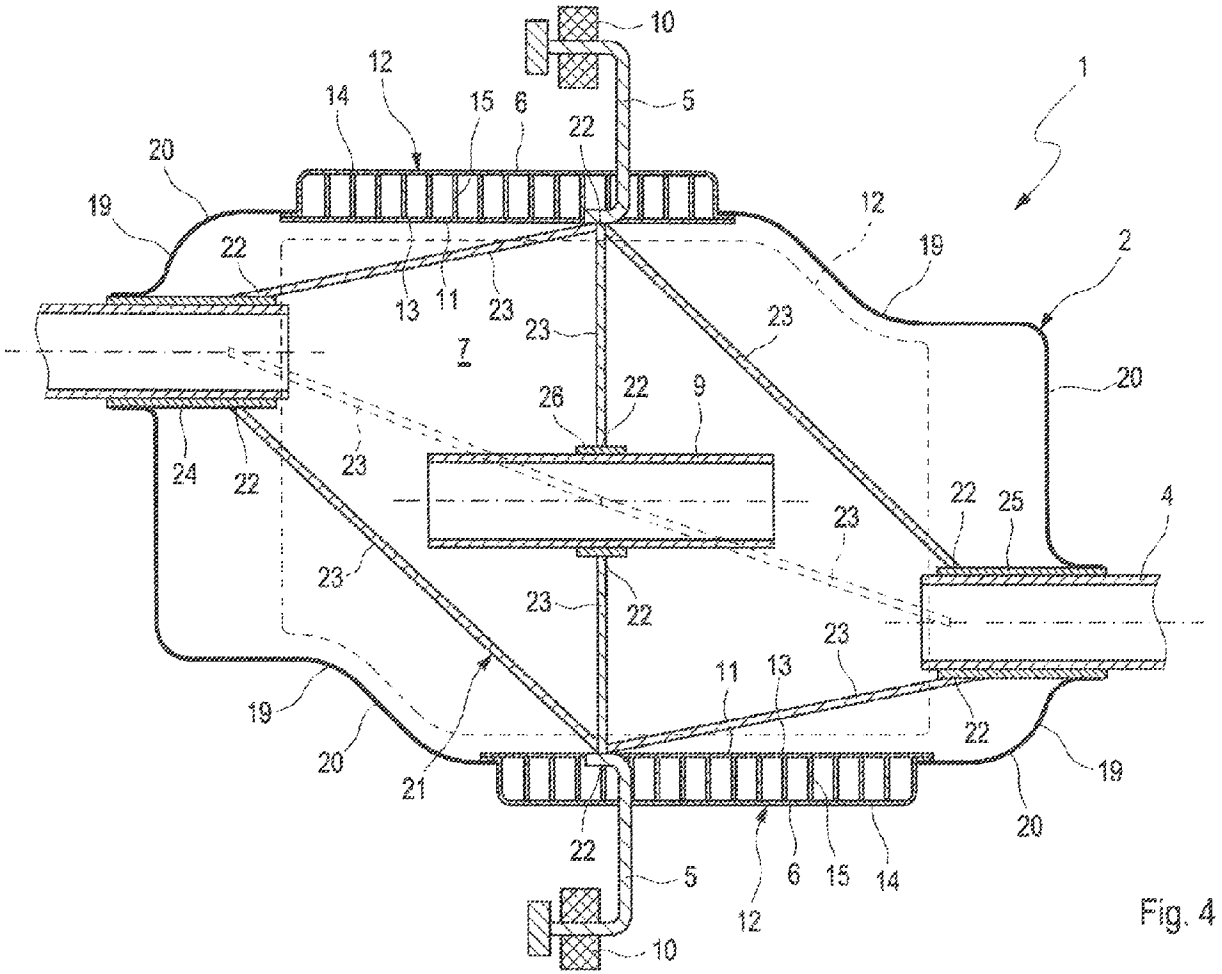
FIG. 4 is a longitudinal sectional view of the muffler from FIG. 3, rotated by 90°.

The muffler 1 can be fastened to a holding structure, not shown here, by means of the respective bracket 5, with two brackets 5 each being shown in the example according to FIGS. 2 and 4. This holding structure may preferably be formed by an underbody area of the vehicle. The corresponding bracket 5 may be provided with an elastomer bearing 10 in order to make it possible to uncouple vibrations between housing 2 and the respective holding structure.

In the muffler 1 being shown here, at least one wall section 11 is formed in at least one of the flat wall areas 6 by a flat lightweight panel 12, which has a sandwich structure. In the example according to FIGS. 1 and 2, the two flat wall areas 6 located opposite each other in the section according to FIG. 1 have two wall sections 11 each, which are formed by such a lightweight panel 12 each. The flat wall areas 6 located opposite each other in the section according to FIG. 2 have only one wall section 11 each formed by such a lightweight panel 12. Thus, a total of six lightweight panels 12 are provided on housing 2 according to the embodiment shown in FIGS. 1 and 2.

The corresponding lightweight panel 12 has a sandwich structure, so that the corresponding lightweight panel 12 is composed from a plurality of parts and is hollow. The corresponding lightweight panel 12 preferably has an inner shell 13, an outer shell 14 and a support structure 15 each. The corresponding support structure 15 is arranged here between inner shell 13 and outer shell 14 and supports the inner shell 13 and outer shell 14 on one another. Furthermore, support structure 15 preferably also brings about fastening of the inner shell 13 to outer shell 14. The inner shell 13 and outer shell 14 preferably extend essentially in parallel to one another, whereas support structure 15 extends, for example, largely at right angles to the planes of the inner shell 13 and outer shell 14. Support structure 15 preferably forms a plurality of honeycombs or cells, whose cell walls extend at right angles to the planes of the inner shell 13 and outer shell 14 and separate two adjacent cells each from each other. Support structure 15 may thus also be called a cell structure or honeycomb structure.

As an alternative, the sandwich structure of the lightweight panel 12 may have a shear-resistant support structure 15 between two cover layers, i.e., inner shell 13 and outer shell 14, which can be welded, bonded or soldered. For example, support structure 15 may have for this two support plates, which have, on a front side, a plurality of elevations, which are prepared, e.g., by deep drawing, project on one side and are arranged, e.g., in rows and columns arranged at right angles to one another. The two support plates are placed on one another with front sides oriented towards each other such that the elevations of one support plate are in contact with the other support plate in intermediate spaces between adjacent elevations in the normal direction of the support plate and vice versa. Furthermore, the elevations and intermediate spaces are advantageously dimensioned or coordinated with one another such that the elevations of one support plate are in contact with adjacent elevations of the other support plate at right angles to the normal direction of the support plates. A support structure 15 having an extremely high shear resistance can be created hereby. Finally, the inner shell 13 and outer shell 14 may be in contact with the rear sides of the support plates and close as a result the depressions, which are complementary to the elevations.

The lightweight panel 12 may be preferably perforated on the inside. For example, the corresponding inner shell 13 of the sandwich structure may be perforated. Pressure equalization can be made possible hereby for the interior space of the essentially hollow sandwich structure. Furthermore, it is possible to reduce a temperature gradient over the lightweight panel 12. In addition, draining of water from the sandwich structure or evaporation of water of condensation from the sandwich structure can be achieved through the perforation.

The corresponding lightweight panel 12 is inserted in the embodiment shown in FIGS. 1 and 2 into an opening 16, which is formed for this purpose in the corresponding flat wall area 6. This opening 16 is enclosed by an opening edge 17 of the flat wall area 6, via which the lightweight panel 12 is fastened to the flat wall area 6. The lightweight panel 12 may be correspondingly flattened for this along a circumferential outer edge 18. To form the outer edge 18, it is possible, e.g., to compress the sandwich structure to the extent that the inner shell 13 and outer shell 14 touch each other. The outer edge 18 of the corresponding lightweight panel 12 can be corresponded in a suitable manner gas-tightly with the opening edge 17 of the flat wall area 6, e.g., by bonding, soldering or welding.

The inner bottoms 8 are preferably fastened to the flat wall area 6 in the embodiment shown in FIGS. 1 and 2, the fastening being located outside the corresponding lightweight panel 12, so that the corresponding lightweight panel 12 does not assume any support function.

Figure 3:
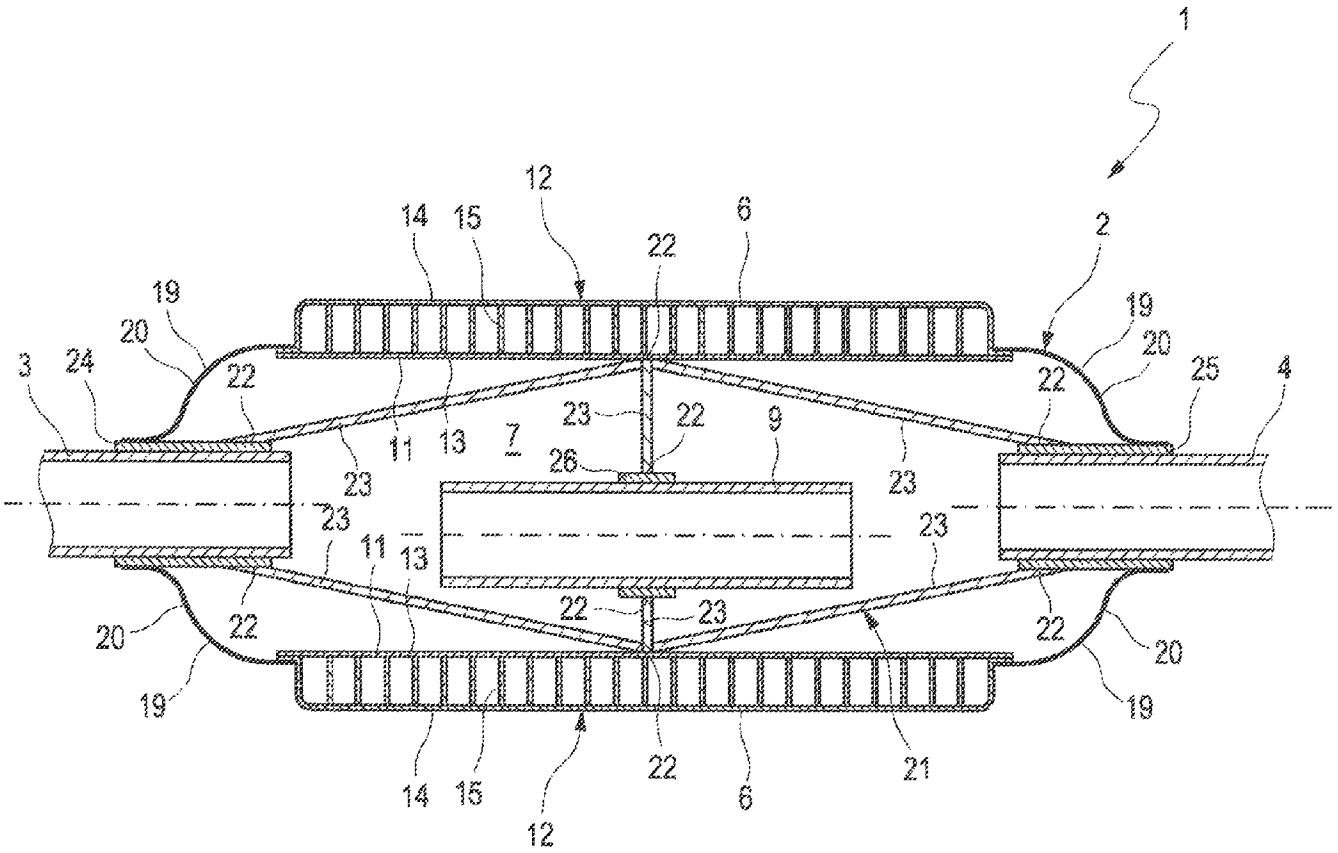
FIG. 3 is a longitudinal sectional view of the muffler as in FIG. 1, but in another embodiment.

In the embodiment shown in FIGS. 3 and 4, the corresponding flat wall area 6 is formed essentially entirely by a lightweight panel 12. The two flat wall areas 6, which are located opposite each other in the section according to FIG. 3, are correspondingly formed each entirely by such a lightweight panel 12. The two flat wall areas 6, which are located opposite each other in the section according to FIG. 4, are likewise formed entirely by such a lightweight panel 12. The lightweight panels 12 have again the sandwich structure with inner shell 13, outer shell 14 and support structure 15 here as well.

According to FIGS. 1 through 4, housing 2 may have at least one non-flat or curved wall area 19 in addition to the flat wall areas 6. If these curved wall areas 19 have a support function, as in the embodiment shown in FIGS. 1 and 2, the curved wall areas 19 may be formed in the conventional manner as a solid wall of a conventional wall thickness of at least 0.5 mm, preferably at least 0.7 mm and especially at least 1.0 mm. Contrary to this, FIGS. 3 and 4 show an embodiment in which the curved wall areas 19 are largely uncoupled from their support function and are formed by a gas-tight film 20 each. Such a film 20 is characterized, unlike a conventional wall, by reduced wall thickness. Film 20 preferably has a wall thickness of at most 0.5 mm, preferably at most 0.3 mm and especially at most 0.1 mm.

As an alternative to such films 20, it is also possible to use curved lightweight panels, which likewise now have a sandwich structure with inner shell 13, outer shell 14 and support structure 15. In particular, shell bodies can now be embodied, in which curved lightweight panels pass in one piece over into flat lightweight panels 12.

To relieve the lightweight panels 12 and films 20 of a support function, the muffler 1 may be provided with a support structure 21 according to FIGS. 3 and 4. This support structure 21 assumes the support functions within the muffler 1. Especially the inlet tube 3, outlet tube 4 and corresponding bracket 5 are fastened for this to support structure 21. The lightweight panels 12 may advantageously also be fastened to the support structure 21. In addition, the films 20 are fastened to support structure 21 in the example shown in FIGS. 3 and 4. In particular, the films 20 extend as a result from the support structure 21 to one of the lightweight panels 12.

Support structure 21 is configured as a self-supporting structure, whereas housing 2, which is formed by the lightweight panels 12 and by the films 20, is not designed as a self-supporting housing. Housing 2 thus assumes the sealing function for surrounding the muffler volume 7 in a gas-tight manner, whereas support structure 21 assumes the support function.

The inner bottoms 8 are eliminated in the embodiments shown in FIGS. 3 and 4. Inlet tube 3 and outlet tube 4 are fixed directly to the support structure 21. The additional tube 9 is likewise fixed to support structure 21.

For example, support structure 21 is designed as a framework structure. It comprises for this a plurality of nodes 22 and a plurality of carriers 23 for connecting the nodes 22. For example, a node 22 is provided in connection with a tube section 24 on the left side in FIGS. 3 and 4 each in order to make it possible to securely support the inlet tube 3. A node 22 is seen on the right side in FIGS. 3 and 4 each in connection with another pipe section 25, by means of which the outlet tube 4 is effectively supported. Another node 22 is provided in connection with a ring 26 in the area of the additional tube 9 in order to reliably support the additional tube 9. Furthermore, the lightweight panels 12 are supported via additional nodes 22 on support structure 21. The brackets 5 are also fixed to the support structure 21 via such nodes 22.

In the example shown in FIGS. 3 and 4, the support structure 21 is designed as an inner support structure 21, which is enclosed essentially by the gas-tight shell, which is formed by the non-support housing 2. However, an embodiment in which the support structure is arranged on the outside, so that a gas-tight shell, which is formed by the non-support housing 2, is accommodated essentially within the support structure 21, is also conceivable as an alternative.

Housing 2 is preferably configured as a shell construction, so that it has at least two housing shells. Each housing shell now has at least one lightweight panel 12 and optionally a curved wall area 19, which may be formed by a film 20 or by a curved lightweight panel. It is possible due to the shell construction to move the support structure 21 largely into the interior of housing 2.

While specific embodiments of the invention have been shown and described in detail to illustrate the application of the principles of the invention, it will be understood that the invention may be embodied otherwise without departing from such principles.

What is claimed is:

1. A muffler for an exhaust system of an internal combustion engine, the muffler comprising:

a housing, which encloses a muffler volume and comprises a flat wall area, said housing comprising a housing surface, said housing surface defining a housing opening;

an inlet tube connected to said housing;

an outlet tube connected to said housing; and a bracket connected to said housing for fastening the muffler to a holding structure, wherein said flat wall area has a flat wall section formed by a flat lightweight panel having a sandwich structure, said flat lightweight panel being inserted in said opening, wherein at least a portion of said flat lightweight panel is arranged in said opening.

2. A muffler in accordance with claim 1, wherein said sandwich structure comprises an inner shell, an outer shell and a support structure arranged between said inner shell and said outer shell, at least one of said support structure supporting said inner shell and said outer shell on one another and said support structure fastening said inner shell to said outer shell, said flat lightweight panel comprising a circumferential outer edge, said circumferential outer edge having a circumferential outer edge outer surface, said housing having a housing portion extending in a direction substantially parallel to a longitudinal axis of said housing, said housing portion comprising an inner housing portion surface, said circumferential outer edge engaging said inner housing portion surface.

3. A muffler in accordance with claim 2, wherein said inner shell is perforated, said inner shell comprising an inner shell portion, said outer shell comprising an outer shell portion, said inner shell portion being substantially parallel to said outer shell portion, said support structure comprising a plurality of support projections, each of said projections being substantially perpendicular to said inner shell portion and said outer shell portion, each of said projections engaging said inner shell portion and said outer shell portion, said inner shell portion, said outer shell portion and said plurality of projections defining a plurality of openings.

4. A muffler in accordance with claim 3, wherein said housing surface defines another opening, said housing surface extending in a circumferential direction of said housing and an axial direction of said housing, said another opening and said opening extending in said circumferential direction and said axial direction, wherein another flat lightweight panel is inserted in said another opening, at least a portion of said another flat lightweight panel being arranged in said another opening, wherein said housing surface surrounds said at least said portion of said another flat lightweight panel, said another flat lightweight panel having a sandwich structure, said outer shell portion being located at a spaced location from said housing portion.

5. A muffler in accordance with claim 1, further comprising an interior support element wherein at least one of said bracket and said interior support element is fastened to said flat wall area in a region outside a region of said lightweight panel.

6. A muffler in accordance with claim 1, said flat wall area is formed entirely by a lightweight panel.

7. A muffler in accordance with claim 1, wherein said housing comprises a non-flat wall area, wherein at least one wall section of said non-flat wall area is formed by a gas-tight film.

8. A muffler in accordance with claim 1, further comprising:

a support structure, to which said inlet tube, said outlet tube, a holder and said lightweight panel are fastened.

9. A muffler in accordance with claim 8, wherein said support structure is self-supporting and said housing is not self-supporting.

10. A muffler in accordance with claim 8, further comprising a tube fastened to said support structure and arranged in said housing.

11. A muffler in accordance with claim 8, wherein said support structure comprises a plurality of nodes for fastening said inlet tube, said outlet tube, said bracket and said lightweight panel and has a plurality of carriers for connecting said nodes.

12. A muffler in accordance with claim 8, wherein:

said support structure is arranged essentially within said housing and comprises a gas-tight, non-self-supporting shell; or said support structure is arranged essentially outside said housing and comprises a gas-tight, non-self-supporting shell.

13. A muffler in accordance with claim 1, wherein said housing comprises a shell construction.

14. A motor vehicle internal combustion engine exhaust system muffler comprising:

a housing, which defines an enclosed muffler volume, said housing comprising a flat wall area, said housing comprising a housing surface having a surface area extending in a circumferential direction of said housing and an axial direction of said housing, said housing surface defining at least a housing opening, said housing opening extending in said axial direction and said circumferential direction;

an inlet tube connected to said housing;

an outlet tube connected to said housing; and a bracket connected to said housing for fastening the muffler to a holding structure, wherein said flat wall area has a flat wall provided by a flat lightweight panel formed by an inner shell, an outer shell and a support structure arranged between said inner shell and said outer shell, said flat lightweight panel being arranged in said housing opening, wherein said flat lightweight panel closes said housing opening to define a sealed housing structure, said housing surface surrounding at least a portion of said flat lightweight panel.

15. A muffler in accordance with claim 14, wherein said housing comprises a non-flat wall area, wherein at least one wall section of said non-flat wall area is formed by a gas-tight film.

16. A muffler in accordance with claim 14, further comprising:

a support structure, said inlet tube, said outlet tube, a holder and said lightweight panel being fastened to said support structure.

17. A muffler in accordance with claim 16, wherein:

said support structure is arranged essentially within said housing and comprises a gas-tight, non-self-supporting shell; or said support structure is arranged essentially outside said housing and comprises a gas-tight, non-self-supporting shell; or said support structure is self-supporting and said housing is not self-supporting.

18. A muffler in accordance with claim 14, further comprising a tube fastened to said support structure and arranged in said housing.

19. A muffler in accordance with claim 14, wherein said sandwich structure comprises an inner shell, an outer shell and a support structure arranged between said inner shell and said outer shell, said flat lightweight panel comprising a circumferential outer edge, said circumferential outer edge having a circumferential outer edge outer surface, said housing portion comprising an inner housing portion surface, said circumferential outer edge outer surface engaging said inner housing portion surface, said inner shell comprising an inner shell portion, said outer shell comprising an outer shell portion, said housing portion being substantially parallel to said outer shell portion, said inner shell portion and said circumferential outer edge, at least a portion of said flat light panel extending through said opening in a radial direction with respect to a longitudinal axis of said housing, said outer shell portion being located at a radially spaced location from said housing portion with respect to said longitudinal axis of said housing.

20. A muffler in accordance with claim 19, wherein said housing surface defines another opening extending in said axial direction and said circumferential direction, wherein another flat lightweight panel is inserted in said another opening, at least a portion of said another flat lightweight panel being arranged in said another opening, wherein said another flat lightweight panel closes said another housing opening to define a portion of said sealed housing structure, at least a portion of said another flat light panel extending through said opening in said radial direction with respect to said longitudinal axis of said housing, said another flat lightweight panel having a sandwich structure.

* * * * *